US005831191A

United States Patent [19]

Zaret

[11] Patent Number: 5,831,191

[45] Date of Patent: Nov. 3, 1998

[54] BASSBAR FOR STRINGED INSTRUMENTS

[76] Inventor: Peter Harold Zaret, 1702 Cloncurry Rd., Norfolk, Va. 23505

[21] Appl. No.: 844,263

[22] Filed: Apr. 18, 1997

[51] Int. Cl.[6] ..... G10D 1/02

[52] U.S. Cl. ..... 84/276

[58] Field of Search ..... 84/274, 275, 276

[56] References Cited

U.S. PATENT DOCUMENTS

| | | | |
|---|---|---|---|
| 10,203 | 11/1853 | Cooner | 84/276 |
| 155,353 | 9/1874 | White | 84/276 |
| 168,820 | 11/1875 | White | 84/276 |
| 353,277 | 11/1886 | White | 84/276 |
| 436,963 | 9/1890 | White | 84/276 |
| 605,942 | 6/1898 | White | 84/276 |
| 766,049 | 7/1904 | Loppentien | 84/276 |
| 958,146 | 5/1910 | Martin | 84/276 |
| 1,012,743 | 12/1911 | Storle | 84/276 |
| 1,042,287 | 10/1912 | Shaw | 84/276 |
| 1,116,754 | 11/1914 | Storle | 84/275 |
| 1,333,088 | 3/1920 | Masterson | 84/275 |
| 1,438,386 | 12/1922 | Lucas | 84/276 |
| 1,551,066 | 8/1925 | Sommers | 84/276 |
| 1,611,100 | 12/1926 | Christy | 84/276 |
| 1,635,502 | 7/1927 | Redlinger | 84/274 |
| 1,881,311 | 10/1932 | Currier | 84/275 |
| 2,068,078 | 1/1937 | Samuelson | 84/276 |
| 2,202,208 | 5/1940 | Kapelman | 84/276 |
| 2,800,051 | 7/1957 | Arlington | 84/276 |
| 3,014,394 | 12/1961 | Szymanski | 84/276 |
| 3,487,740 | 1/1970 | Tansky | 84/276 |
| 3,494,239 | 2/1970 | Kasha | 84/276 |
| 4,372,189 | 2/1983 | Johnson | 84/276 |

*Primary Examiner*—Cassandra C. Spyrou
*Assistant Examiner*—Shih-Yung Hsieh
*Attorney, Agent, or Firm*—Kaufman & Canoles

[57] ABSTRACT

A stringed instrument of the violin or viol family is provided having an improved bassbar. The bassbar is elongated and has an attachment surface adapted to conform to the interior surface of the top face of the violin. The bar has a generally constant traverse width along the bottom length of the bar at the attachment surface. In an intermediate region of the bar, the transverse width of the bar increases from the attachment surface to the top region of the bar. The height of the bar in the intermediate region is greater than the height of the bar at the end segments, thus resulting in a convex area along the length the bar in the intermediate region. Thus, mass is added to the top region of the bassbar in an intermediate portion of the bar.

26 Claims, 4 Drawing Sheets

BASSBAR FOR STRINGED INSTRUMENTS

FIELD OF THE INVENTION

This invention relates to stringed musical instruments in the violin and viol family, and more particularly to such instruments having an improved bassbar.

BACKGROUND OF THE INVENTION

The violin and viol families of stringed instruments include the violin, viola, violoncello, bass viol, viola da gamba, double bass, viola da braccio, viola d'amore and others . A typical violin includes a sound box having upper and lower bouts. A sound post is located inside the sound box and is coordinated with the right (treble) f-hole. Also located internally is a bassbar which is coordinated with the left (bass)f-hole. As disclosed in U.S. Pat. No. 3,494,239 issued to Kasha, which is incorporated by reference, a conventional bassbar acts to support the top plate and distribute localized vibrations on the top plate due to vibrations of the bridge. As illustrated in "Violin Restoration, A Manual for Violin Makers" by Hans Weisshaar and Margaret Shipman, the conventional bassbar for a violin has a constant transverse width at its base of 5.5–6 mm along its entire length. This width gradually diminishes from the base of the bar to the top surface of the bar. In addition, a central region of the bar has a longitudinal, convex, arched region with a peak height of 11–13 mm which gradually diminishes to about 3–4 mm at each end of the bar.

This traditional type of bassbar is extremely stiff, which tends to make the overall tone too bright. At the same time, the tone is muted with this type of bassbar because too much mass contacts the sound board (top). The traditional bassbar also inhibits the response (i.e., ease of playing) because of the added stiffness, particularly in the middle of the bassbar, essentially under the bass bridge foot.

Various attempts have been made to improve the tonal qualities of these instruments by modifying the bassbar. Such modifications have included cutting an arch into the bar (U.S. Pat. No. 3,494,239 issued to Kasha). To make this configuration work, Kasha makes a new bridge that acts in conjunction with the modified bassbar. Although this design attempts to solve the problems of response under the lower strings and dulling and stultifying on the lower two strings, such modifications have a negative effect on other areas. U.S. Pat. No. 4,372,189, issued to Johnson, discloses applying a weight to a portion of the bar. However, this approach addresses only the volume of the violin. U.S. Pat. No. 3,014,394, issued to Szymanski, discloses continuously varying the transverse width of the bar while providing a convex protuberance along a portion of the length of the bar. Although this configuration is close to that of a conventional bassbar, this modified bassbar loses the teeter totter effect (longitudinal vibration) and is too asymmetrical to work well.

SUMMARY OF THE INVENTION

To overcome these and other disadvantages of prior art devices, a stringed instrument of the violin or viol family is provided having an improved bassbar. The bassbar is an elongated bar having an attachment surface adapted to conform to the interior surface of the top face of the violin. The bar has a generally constant traverse width along the bottom length of the bar at the attachment surface. In an intermediate region of the bar, the transverse width of the bar increases from the attachment surface to the top region of the bar. The height of the bar in the intermediate region is greater than the height of the bar at the end segments, thus resulting in a convex area along the length the bar in the intermediate region. Thus, mass is added to the top region of the bassbar in an intermediate portion of the bar.

The bassbar of the present invention permits the top of the violin to more freely vibrate in all frequencies, yet the bassbar slows down the vibrations more under the lowest two strings. This effect is obtained as a result of the added weight and mass on the top part of the intermediate portion. Since this added weight and mass is not touching the sounding board (top), it does not act to mute it or make it stiffer in the manner observed in traditional bassbars.

The present bassbar can vibrate both laterally and longitudinally while providing mass in the intermediate portion to slow down the vibrations under the lowest two strings, G and D, which vibrate at a lower frequency. In the lower frequencies, the bassbar moves laterally; while in the middle frequencies, the bassbar moves longitudinally; and, in the upper frequencies, the reduced mass that touches the sound board of the violin allows the upper frequencies to be freer. In addition, there is less clamping from the bassbar.

The instrument having the bassbar of the present invention provides an improved response of the instrument (i.e., ease of playing), produces more power and greater depth in the lower registers. In addition, it produces greater brilliance in the upper registers and an even, powerful and warm tone throughout the instrument. More bass is achieved by adding mass to the top of the intermediate portion of the bassbar rather than removing mass from the bassbar, soundboard and the back. In prior bassbars, the tone was made darker rather than deeper by thinning the sound board, back and the bassbar. This resulted in a loss of power. In the present invention, mass is added while adding power and improving the bass register. Mass is added without muting, and mass is added while also achieving better response.

DETAILED DESCRIPTION OF THE PREFERRED EMBODIMENT

Figure 1:
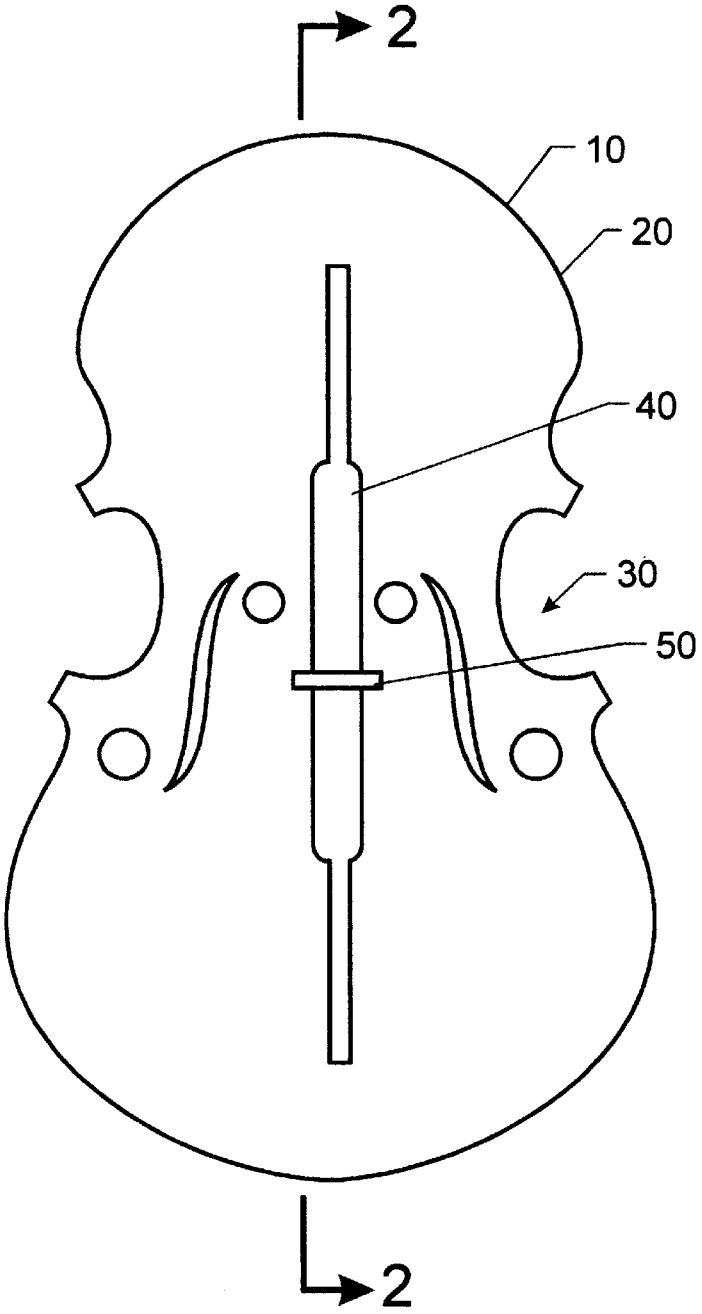
FIG. 1 is a plan view of the interior of the top face of a violin.
Figure 2:
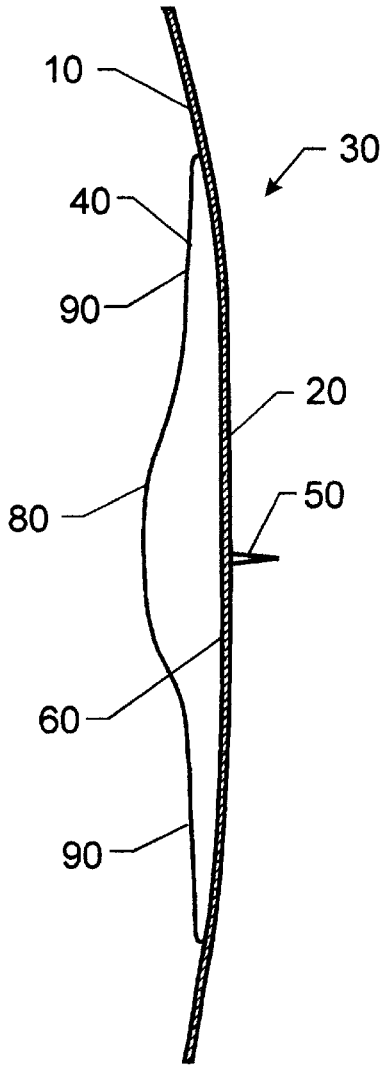
FIG. 2 is a longitudinal cross-section view of the bassbar along line 2—2 of FIG. 1.

As shown in the preferred embodiment of FIG. 1, the interior surface 10 of the upper face 20 of an instrument such as a violin 30 has an elongated bassbar 40, such that a portion of the bassbar 40 passes under the bridge 50 of the violin 30. For a violin, the bassbar is typically about 270–275 mm in length. As shown in FIG. 2, the bottom 60 of the bassbar is attached along its length to the interior surface 10 of the upper face 20 of the violin, by any suitable means such as with an adhesive. The bottom 60 of the bassbar 40 is configured to match the inner surface 10 of the violin face 20 to which it will be attached. An intermediate portion 80 of the bassbar has a width at the bottom portion 60 of the bassbar which is up to approximately 3–4 mm and remains essentially constant along the length of the intermediate portion 80. The intermediate portion 80 of the bassbar has a height of about 17–19 mm in the center and gradually decreases in height to the end portions 90 of the bassbar, such that a convex area is formed in the intermediate portion 80 that gradually tapers into the end portions 90. This convex area is generally about 3/7 the overall length of the bassbar. However, the ratio may vary depending on the desired degree of convex curvature or the amount of flexibility desired in the bassbar.

Figures 3A, 3B, 3C:
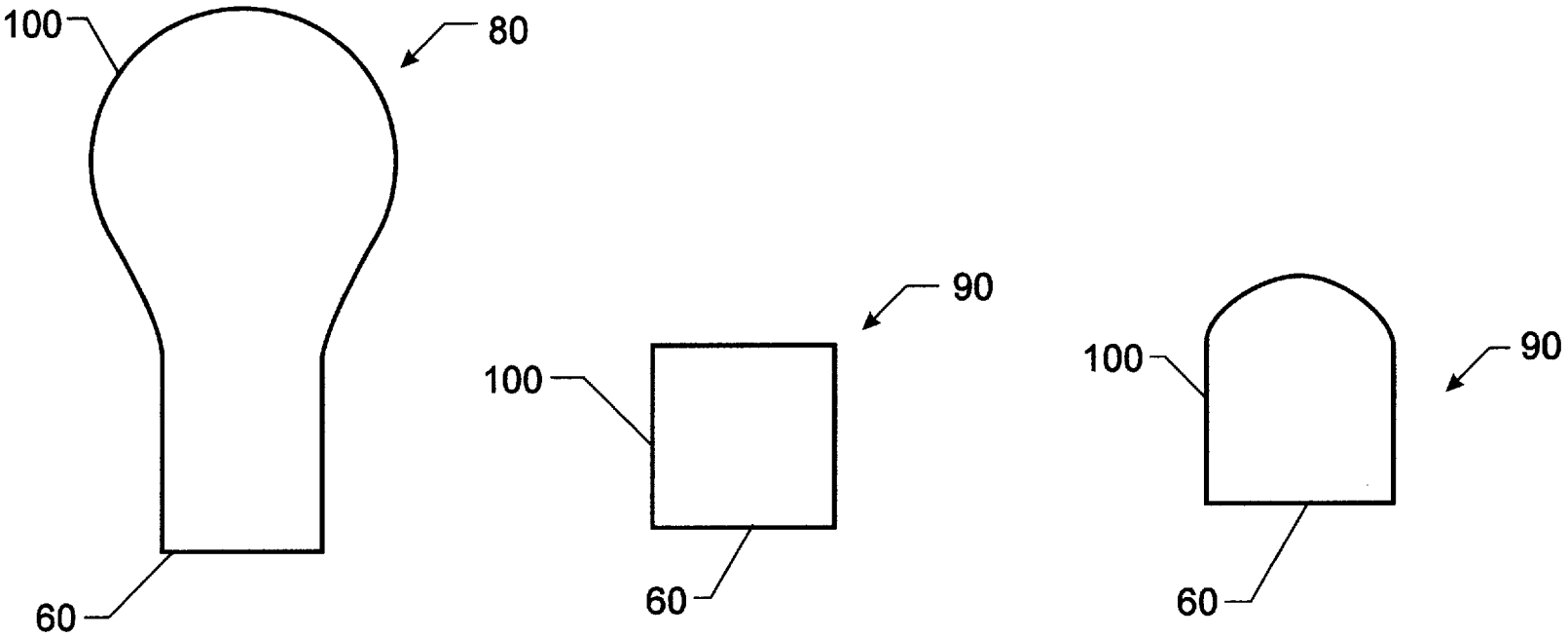
FIG. 3A is a transverse cross-section view of the bassbar in the intermediate portion of the bar.
FIG. 3B is a transverse cross-section view of the bassbar in the end portion of the bar.
FIG. 3C is a transverse cross-section view of another configuration of the bassbar in the end portion of the bar.

As shown in FIG. 3A, the transverse width of the bassbar in the intermediate portion 80 increases from about 3–4 mm at the bottom 60 to about 7–9 mm at the top 100 region at its widest point so that the cross-section of the bassbar in the intermediate portion 80 has a generally bulbous appearance. The width of the bassbar in the end portions 90, as shown in FIG. 3B, is approximately 3–4 mm and remains generally constant from the bottom 60 to the top 100 of the bassbar 40 so that a cross-section is generally square or rectangular. The height at each end is approximately 3 mm, however, the top 100 of the bassbar may also be slightly rounded to a convex curvature as shown in FIG. 3C.

Figure 4:
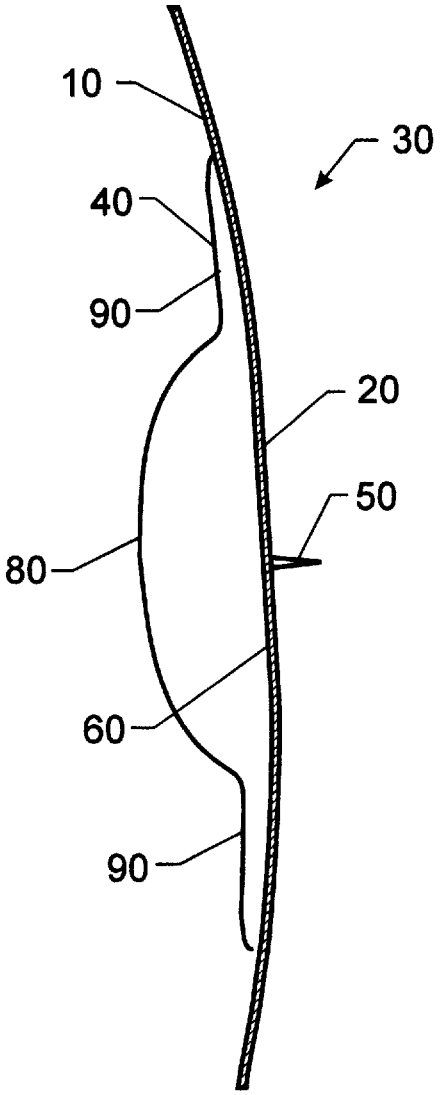
FIG. 4 is a longitudinal cross-section of an alternate embodiment of the bassbar.

In a second embodiment of the invention, as shown in FIG. 4, the intermediate portion 80 of the bassbar 40 has a convex area approximately 17–19 mm high at the center of the convex area. At each end of the intermediate portion 80, the convex area abruptly transitions to the end portion 90 which is approximately 3 mm in height and 3–4 mm wide at the bottom 60 to the end of the bassbar 40. This configuration provides increased longitudinal flexibility of the bassbar in the transition areas between the intermediate portion 80 and the end portions 90. Alternatively, the height of the end portions 90 may be higher than 3 mm at the transition to the intermediate portion 80, and continuously decrease to about 3 mm at each end, in order to decrease the flexibility at this transition area. The cross-section of the intermediate portion 80 is generally bulbous-shaped as in FIG. 3A for the first embodiment, whereas the end portions 90 are substantially flat at the top 100 so that the cross-section is generally square or rectangular, as shown in FIG. 3B, or the top 100 has a convex curvature as shown in FIG. 3C. The width of the top region 100 of the intermediate portion 80 at its widest point is about 7–9 mm and the width at the bottom 60 is about 3–4 mm.

Figure 5:
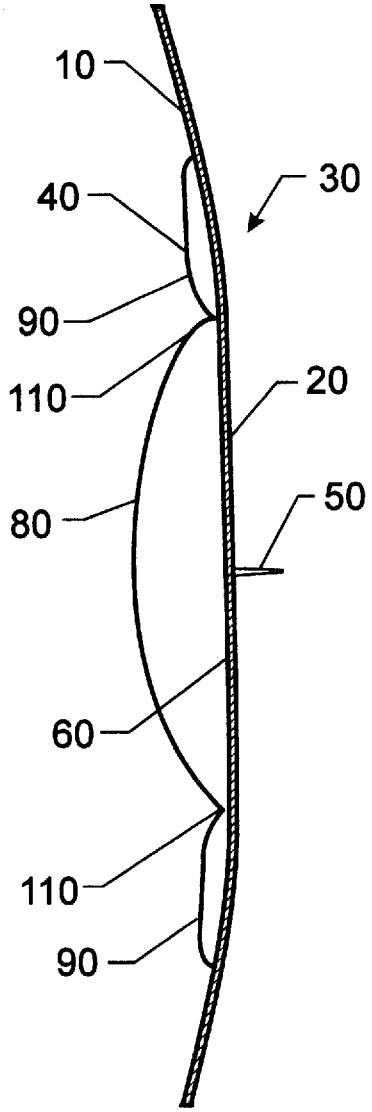
FIG. 5 is a longitudinal cross-section of another embodiment of the bassbar.

As shown in FIG. 5, a third embodiment of the invention comprises the bassbar 40 having an intermediate portion 80 with a convex area about 17–19 mm high at the center and having end portions 90 about 3 mm high at the ends of the bassbar 40. The intermediate portion 80 gradually transitions to the end portions 90. However, at the intersection of the intermediate 80 and end 90 portions there is a concave notch 110, such that the bottom of the notch 110 is about 4 mm from the bottom 60 of the bassbar. As in the second embodiment discussed above, this configuration provides increased longitudinal flexibility of the bassbar in the transition areas between the intermediate portion 80 and the end portions 90. The intermediate 80 and end 90 portions have transverse cross-sections which are similar those in the first and second embodiments.

In selecting the precise configuration of the bassbar, it is important to keep in mind the configuration serves as a control mechanism for the instrument. For example, in the intermediate portion 80, a wider or higher top region 100 produces a deeper tone, while a wider bottom 60 produces a brighter tone. In related fashion, the thinner bottom 60 produces a darker tone and creates an easier response. In addition, in the end portions 90, the higher or wider the bassbar, the brighter the tone.

The bassbar 40 is preferably made from spruce, fir, pine or other types of wood which can provide the appropriate support and tonal properties required for the instrument. Although woods have traditionally been used for bassbars, any other material may be used that will provide the necessary support without degrading the tonal qualities of the instrument.

Although the invention has been described relative to exemplary embodiments thereof, it will be understood by those skilled in the art that variations and modifications can be effected in these exemplary embodiments without departing from the scope and spirit of the invention. For example, although the bottom width 60 of the intermediate 80 and end 90 portions have been described as up to about 3–4 mm, the width can also vary up to about 5.5–6.0 mm. In addition, the width of the bottom 60 of the intermediate portion 80 can be different than the width of the bottom 60 of the end portions 90. The height of the convex area in the intermediate portion 80 can also vary, but the height at the peak of the convex area will be at least about 16 mm. The width of the top region 100 can also be greater than 9 mm. The height of the notch in the transition area can also vary to modify the spring in the bassbar. Although the cross-section of the end portions 90 is generally square or rectangular, the vertical sides may be slightly angled such that the top 100 of the end portions 90 have a slightly different width than the bottom 60 of the end portions 90. As a general rule, the less width at the bottom of the bassbar, the better it is acoustically. However, this must be weighed against not having enough bonding surface to hold the bassbar in place, or giving enough support to the G and D string.

Figure 6A:
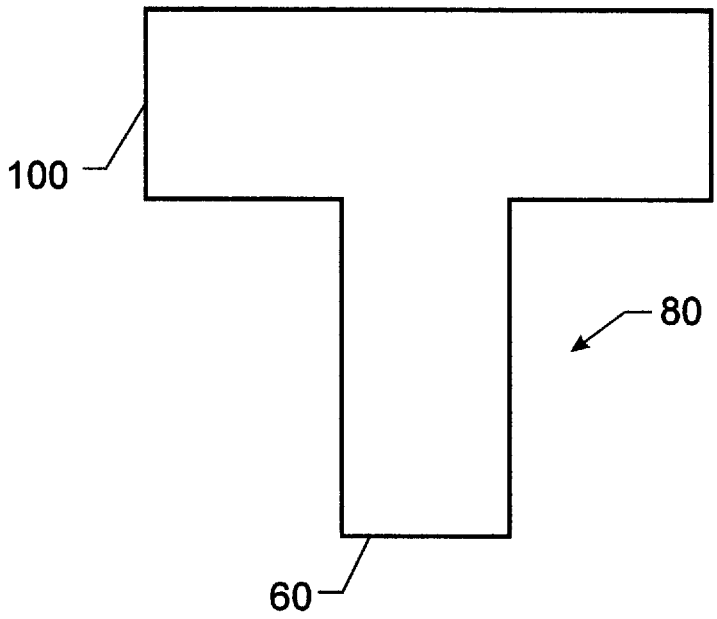
FIG. 6A is a transverse cross-section view of a T-shaped embodiment of the bassbar.
Figure 6B:
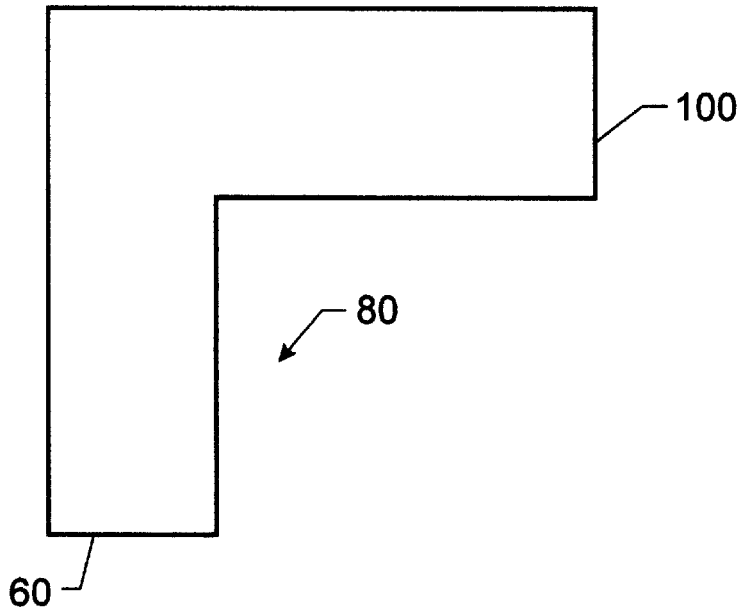
FIG. 6B is a transverse cross-section view of an L-shaped embodiment of the bassbar.

Although the cross-section of the intermediate portion 80 has been illustrated as bulbous-shaped, the cross-section can also be T-shaped or L-shaped, as shown in FIGS. 6A and 6B or any other shape in which the upper region 100 of the intermediate portion 80 has a wider width than the lower region 60 of the intermediate portion 80. Also, although the bassbar has been illustrated as a one-piece structure, it can be formed in sections and adhesively joined to form the required configuration of the structure. For example, the T-shaped bassbar shown in FIG. 6A may be formed from separate horizontal and vertical bars which are glued together. Multiple pieces can be added or subtracted. The more that is added to the upper region 100 of the intermediate portion, the deeper the tone will become. Although conventional bassbar construction required a specific grain orientation when wood was used, the bassbar of the present invention is not limited by the grain direction. The piece or pieces that make up the bassbar 40 can be bent to a desired shape or carved and then glued to the interior surface 10 of the upper face 20, or put on and then carved to the desired shape. This flexibility in the method of adding to the bassbar can save enormous amounts of time when trying to obtain the proper tonal qualities.

What is claimed is:

1. A stringed instrument of the viol or violin family, comprising:

a hollow body having an upper face, the upper face having an inner side; and a bassbar having a bottom surface which is adhesively attached to the inner side of the upper face, the bassbar further comprising two end portions and an intermediate portion, the intermediate portion having a convex curvature in a longitudinal direction, wherein the minimum transverse width of the intermediate portion is constant and is at the bottom surface of the bassbar and the maximum transverse width of the intermediate portion is constant and is at a top region of the bassbar, and the maximum traverse width is greater than the minimum traverse width.

2. The stringed instrument of claim 1, wherein the intermediate portion gradually transitions to the end portions.

3. The stringed instrument of claim 2, wherein the transverse width of the bottom surface of the bassbar is substantially constant throughout the entire length.

4. The stringed instrument of claim 3, wherein the transverse cross-section of the intermediate portion of the bassbar is substantially bulbous-shaped.

5. The stringed instrument of claim 4, wherein the minimum transverse width of the intermediate portion is less than about 6 mm.

6. The stringed instrument of claim 5, wherein the peak of the convex curvature of the intermediate portion is at least about 16 mm.

7. The stringed instrument of claim 6, wherein the maximum transverse width of the top region of the bassbar is at least about 7–9 mm.

8. The stringed instrument of claim 2, wherein the transverse cross-section of the intermediate portion of the bassbar is T-shaped.

9. The stringed instrument of claim 2, wherein the transverse cross-section of the intermediate portion of the bassbar is L-shaped.

10. The stringed instrument of claim 2, further comprising a vertical notch in the transition areas between the intermediate portion and the end portions.

11. The stringed instrument of claim 10, wherein the height from the bottom of the bassbar to the notch is about 4 mm.

12. The stringed instrument of claim 1, wherein the intermediate portion abruptly transitions to the end portions.

13. The stringed instrument of claim 12, wherein the height of the end portions is substantially constant.

14. A bassbar for attachment to the inner side of an upper face of a stringed instrument of the viol or violin family, the bassbar comprising: a bottom surface which is conformable to the inner side of the upper face, the bassbar further comprising two end portions and an intermediate portion, the intermediate portion having a convex curvature in a longitudinal direction, wherein the minimum transverse width of the intermediate portion is constant and is at the bottom surface of the bassbar and the maximum transverse width of the intermediate portion is constant and is at a top region of the bassbar.

15. The bassbar of claim 14, wherein the intermediate portion gradually transitions to the end portions.

16. The bassbar of claim 15, wherein the transverse width of the bottom surface of the bassbar is substantially constant throughout the entire length.

17. The bassbar of claim 16, wherein the transverse cross-section of the intermediate portion of the bassbar is substantially bulbous-shaped.

18. The bassbar of claim 17, wherein the minimum transverse width of the intermediate portion is less than about 6 mm.

19. The bassbar of claim 18, wherein the peak of the convex curvature of the intermediate portion is at least about 16 mm.

20. The bassbar of claim 19, wherein the maximum transverse width of the top region of the bassbar is at least about 7–9 mm.

21. The bassbar of claim 15, wherein the transverse cross-section of the intermediate portion of the bassbar is T-shaped.

22. The bassbar of claim 15, wherein the transverse cross-section of the intermediate portion of the bassbar is L-shaped.

23. The bassbar of claim 15, further comprising a vertical notch in the transition areas between the intermediate portion and the end portions.

24. The bassbar of claim 23, wherein the height from the bottom of the bassbar to the notch is about 4 mm.

25. The bassbar of claim 14, wherein the intermediate portion abruptly transitions to the end portions.

26. The bassbar of claim 25, wherein the height of the end portions is substantially constant.

* * * * *